US005230309A

United States Patent [19]

Suga et al.

[11] Patent Number: 5,230,309

[45] Date of Patent: Jul. 27, 1993

[54] SPARK PLUG HEATER CONTROL SYSTEM FOR INTERNAL COMBUSTION ENGINE

[75] Inventors: Toshiyuki Suga; Hiroki Kodama; Shinichi Kitajima, all of Wako; Yoshihiko Kobayashi, Haga, all of Japan

[73] Assignee: Honda Giken Kogyo Kabushiki Kaisha, Tokyo, Japan

[21] Appl. No.: 974,024

[22] Filed: Nov. 10, 1992

[30] Foreign Application Priority Data

Nov. 11, 1991 [JP] Japan ..... 3-321558
Dec. 24, 1991 [JP] Japan ..... 3-339258
Dec. 25, 1991 [JP] Japan ..... 3-342872

[51] Int. Cl.[5] ..... F02D 41/06; F02D 43/00; F02P 1/00

[52] U.S. Cl. ..... 123/169 PB; 124/179.6

[58] Field of Search ..... 123/169 PB, 169 R, 169 CL, 123/169 P, 1 A, 179.6, 179.14, 179.16, 179.5

[56] References Cited

U.S. PATENT DOCUMENTS 1,805,040 5/1931 Groves ..... 123/169 PB
2,048,481 7/1936 Arnois ..... 123/169 PB
3,868,939 3/1975 Friesca et al. ..... 123/179 L
4,205,650 6/1980 Szwarcbier ..... 123/179 H
4,387,676 6/1983 Coucriro ..... 123/179 G
4,433,665 2/1984 Abe et al. ..... 123/179 G
4,870,932 10/1989 Asmus ..... 123/179 H
5,044,331 4/1991 Swan et al. ..... 123/179 G

FOREIGN PATENT DOCUMENTS 49-8651 2/1974 Japan .
60-42291 3/1985 Japan .

*Primary Examiner*—Raymond A. Nelli
*Attorney, Agent, or Firm*—Nikaido, Marmelstein, Murray & Oram

[57] ABSTRACT

A system for controlling heater mounted on a spark plug which ignites the air-fuel mixture in the combustion chamber of an internal combustion chamber. The heater-on time is determined such that it decreases with increasing engine temperature and increasing alcohol concentration. Current supplied to the heater is also determined such that it increases with increasing alcohol concentration and decreases with increasing engine temperature. Therefore, droplets at the spark plug caused by high alcohol concentration fuel can be removed while eliminating carbon fouling. The engine startablity can thus been improved without shorting the service life of the spark plug. Moreover, fuel injection amount is reduced so as not another fuel be deposited on a droplet fuel which is still being present. The heater is furthermore kept off when a starter motor is turning to supply sufficient power to the motor.

22 Claims, 8 Drawing Sheets

SPARK PLUG HEATER CONTROL SYSTEM FOR INTERNAL COMBUSTION ENGINE

BACKGROUND OF THE INVENTION

1. Field of the Invention

This invention relates to a system for controlling a heater mounted on a spark plug igniting the air-fuel mixture introduced into the combustion chamber of an internal combustion engine, and more particularly to such a system for use in an internal combustion engine which uses a hybrid fuel consisting of a blend of gasoline and alcohol.

2. Description of the Prior Art

In a gasoline engine, gasoline (the fuel) is introduced into the combustion chambers together with air in the form of an air-fuel mixture. When the air-fuel mixture in a combustion chamber is ignited it burns explosively. For igniting the air-fuel mixture, there is generally used a spark plug which produces an electric spark. The spark plug has a pair of electrical discharge electrodes disposed across a gap of prescribed magnitude. A high voltage is applied across the electrodes to produce a spark discharge between them. The air-fuel mixture in the combustion chamber is ignited by the spark accompanying the discharge.

In a system using a spark plug of this type, since the spark producing portion of the spark plug (the discharge electrode portion) is disposed in the combustion chamber, a phenomenon known as "carbon fouling" occurs when the spark plug temperature is too low. Namely, the spark producing portion may be fouled with carbon and other products of incomplete combustion. When this happens, electricity leaks through the adhering carbon, reducing the voltage between the discharge electrodes and weakening the spark.

For avoiding this problem, it has been proposed, in Japanese Laid-Open Utility Model Publication No. 60(1985)-42291, for example, that a heater be mounted in the vicinity of the spark producing portion of the spark plug and be turned on to heat the spark plug when the engine is cold. In a system equipped with an auxiliary low-temperature starting device of this type, the heating of the spark plug ensures that any carbon adhering to the spark producing portion will be burned off. In other words, carbon and other fouling materials will be removed by a self-cleaning effect. Similar technique has also been proposed in Japanese Patent Publication No. 49(1974)-8651.

On the other hand, an increasing number of engines which use a hybrid fuel consisting of a blend of gasoline and alcohol are being put into use nowadays, mainly with the aim of reducing gasoline consumption. Since alcohol has a higher boiling point and larger latent heat of vaporization than gasoline, in such an engine the fuel tends to form droplets in the combustion chambers. Therefore, during a cold engine start, liquid alcohol is apt to adhere between the spark plug electrodes. As this reduces the electrical insulation between the electrodes, it may become impossible to develop a high enough discharge voltage to produce a spark.

If the engine uses the heater-equipped spark plug just referred to, the heating of the discharge electrode portion when the heater is turned on will vaporize any alcohol adhering between the electrodes and thus ensure reliable production of a discharge spark.

A problem arises, however, owing to the fact that when a gasoline-alcohol blend fuel is used and supplied to the combustion chamber, the alcohol concentration of the blended fuel does not stay constant. Since the amount of liquid alcohol adhering to the spark plug discharge electrodes increases with increasing alcohol concentration of the fuel, the heating of the spark plug is able to reliably prevent adherence of liquid alcohol only if the heating temperature is set high enough to vaporize the adhering liquid alcohol when the alcohol concentration is at its highest. The heater thus has to raise the spark plug to a considerably high temperature. This temperature is higher than the temperature for burning off carbon adhering to the electrodes.

Heating the spark plug to the required temperature accelerates electrode consumption. It also increases the risk of plug burnout. The service life of the spark plug is therefore reduced. In addition, as a larger amount of power has to be supplied to the heater, power consumption is increased.

SUMMARY OF THE INVENTION

This invention was accomplished for overcoming the aforesaid drawbacks and its object is to provide a control system which uses a heater mounted on a spark plug for promoting vaporization of fuel present between the discharge electrodes of the spark plug, wherein the electric power consumption by the heater is suppressed and the service life of the spark plug is increased even when a hybrid fuel consisting of a blend of alcohol and gasoline is used.

Further, in the gasoline-alcohol blend fuel, since latent heat of vaporization or atomization of alcohol is greater than that of gasoline, fuel vaporization decreases with increasing fuel alcohol concentration. If greater amount of fuel, not atomized, adheres to the spark plug, the situation progressively degenerates because fuel is successively supplied while fuel, not yet atomized by spark plug heating, is still present on the spark plug heater. The spark plug could thus become wet, making the engine hard to start.

Another object of the invention is therefore to provide a control system which further improve low-temperature engine startability.

Furthermore, the aforesaid another reference, Japanese Patent Publication No. 49(1974)-8651 also teaches that starting performance of an engine can be improved by mounting the heater on the spark plug and turning on the heater to warm the spark plug tip when the ignition switch is turned on. In the proposed arrangement, the heater is turned on when the ignition switch is turned and remains on even after the starter switch is turned on. When the starter switch is turned on, a large amount of power is suddenly required to operate the starter motor. Because of this, if, as in arrangement described in the aforesaid prior reference, the heater is left on even after the starter switch is turned on, there may be insufficient power available to operate the starter motor.

Moreover, as repeatedly mentioned earlier, in the engine using the gasoline-alcohol blend fuel, the engine starting performance tends to worsen with increasing alcohol concentration because a fuel with a high alcohol concentration is poorer in atomization property and, as such, tends to wet the spark plug at time of a cold engine start. This problem is coped with, as earlier proposed, by turning on the heater so as to vaporize any fuel adhering to the spark plug.

Further object of the invention is therefore to provide a control system which enables the starter motor to be supplied with sufficient electric power for its operation if the engine uses the gasoline-alcohol blend fuel, when the starter motor is turned on.

For realizing these objects, the present invention provides a system for controlling a heater mounted on a spark plug which ignites the air-fuel mixture in a combustion chamber of an internal combustion engine using a gasoline-alcohol blend fuel, comprising first means for detecting alcohol concentration in the fuel and control means for controlling an amount of current to be supplied to the spark plug heater in such a manner that the amount of current to be supplied to the spark plug heater increases with increasing alcohol concentration in the fuel.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

An embodiment of the invention will now be explained with reference to the attached drawings.

Figure 1:
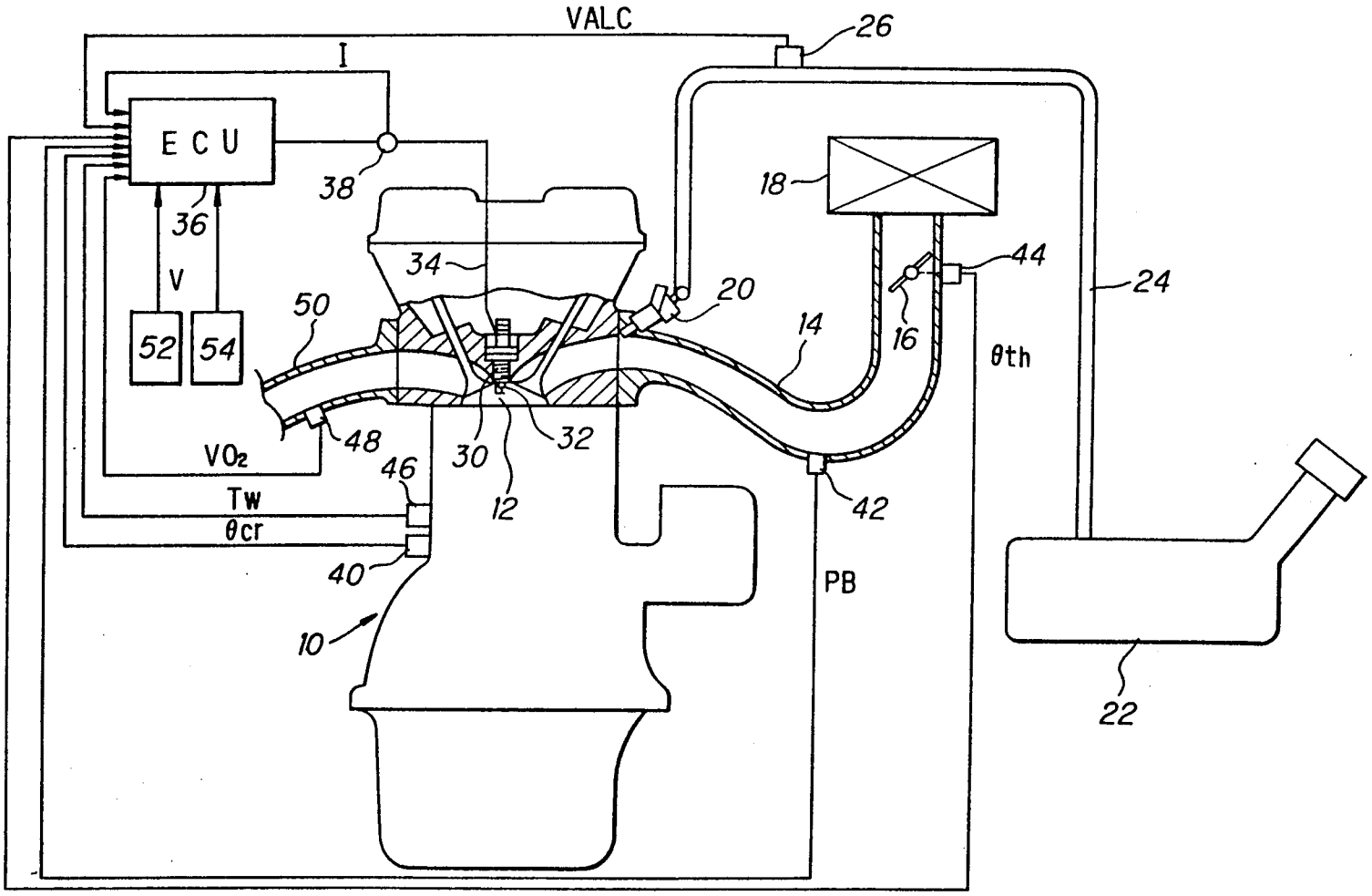
FIG. 1 is a schematic view showing a spark plug heater control system for an internal combustion engine having a spark plug with a heater mounted thereon according to the invention.

As shown in FIG. 1, a main engine unit 10 has a combustion chamber 12. Air is supplied to the combustion chamber 12 through an air intake manifold 14 having a throttle valve 16 therein and an air cleaner 18 at its distal end. A fuel injector 20 is provided at the connection between the intake manifold 14 and the main engine unit 10 for injecting fuel into the air drawn into the combustion chamber 12. An air-fuel mixture is thus supplied to the combustion chamber 12.

The fuel injector 20 is connected with a fuel tank 22 via a fuel pipe 24. The fuel tank 22 contains a blend of gasoline and alcohol, which is pumped by a fuel pump (not shown) mounted inside the fuel tank 22 and then delivered to the fuel injector 20. An alcohol sensor 26 is provided in the fuel pipe 24 for detecting the alcohol concentration of the blended fuel passing therethrough.

Figure 2:
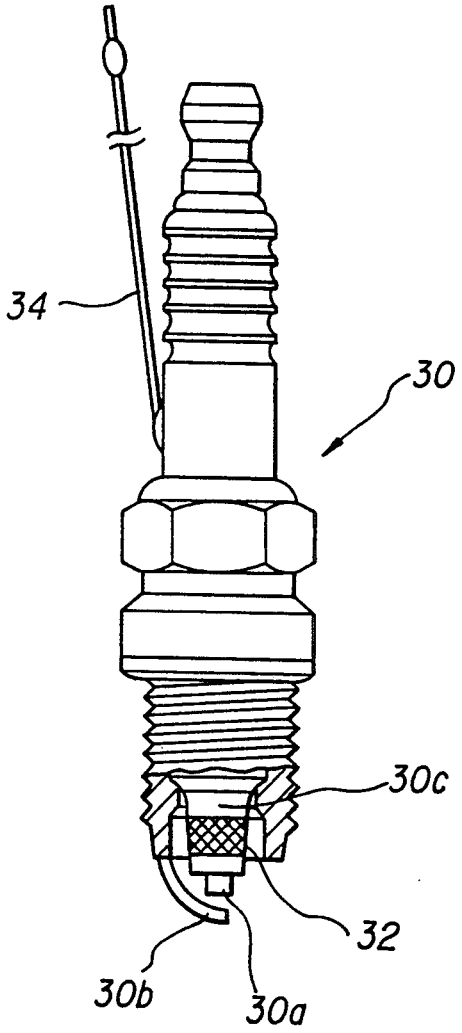
FIG. 2 is an enlarged view of the spark plug shown in FIG. 1.

A spark plug 30 is installed at the top center of the combustion chamber 12 for igniting the air-fuel mixture introduced therein. As shown in FIG. 2, the spark plug 30 is formed at its tip with a pair of discharge electrodes, namely a center electrode 30*a* and a ground electrode 30*b*, and is mounted on the main engine unit 10 with the electrodes 30*a*, 30*b* projecting into the combustion chamber 12. The electrodes 30*a*, 30*b* are separated from each other by a small gap. A high voltage is applied across the electrodes 30*a*, 30*b* to produce a spark discharge and ignite the air-fuel mixture. An electric heater 32 is provided to encompass the periphery of an insulator 30*c* at the tip of the spark plug 30. A lead wire 34 connected with the spark plug 30 supplies the electric current for the heater 32. As shown in FIG. 1, the other end of the lead wire 34 is connected with an electronic control unit (ECU) 36 made up of a microcomputer. The ECU 36 determines the time and amount of current to be supplied to the heater 32 of the spark plug 30. The amount or level of the current is detected through an ammeter 38.

A crankshaft angle sensor 40 is provided at a portion of the main engine unit 10 to successively produce a pulse signal $\theta cr$ once per predetermined crankshaft angles, which is sent to the ECU 36 to be counted to detect an engine speed. A pressure sensor 42 is installed in the intake manifold 14 downstream of the throttle valve 16 to detect a manifold pressure PB and a throttle position sensor 44 is equipped in the proximity of the throttle valve 16 to detect its opening degree $\theta th$. A temperature sensor 46 is provided at a water-filled jacket, not shown, to detect a temperature Tw thereat and an oxygen sensor 48 is provided at an exhaust pipe 50 to detect an oxygen content $VO_2$ in the exhaust gas. Moreover, a speed sensor 52 is provided at a drive shaft, not shown, of a drive train, not shown, to generate a pulse signal which is also sent to the ECU 36 to be counted to detect a vehicle road speed, and a starter switch is provided to detect if a starter motor, not shown, is turning on. As well as the sensors 40, 52, output signals of the other sensors or the switch are similarly forwarded to the ECU 36.

Figure 3:
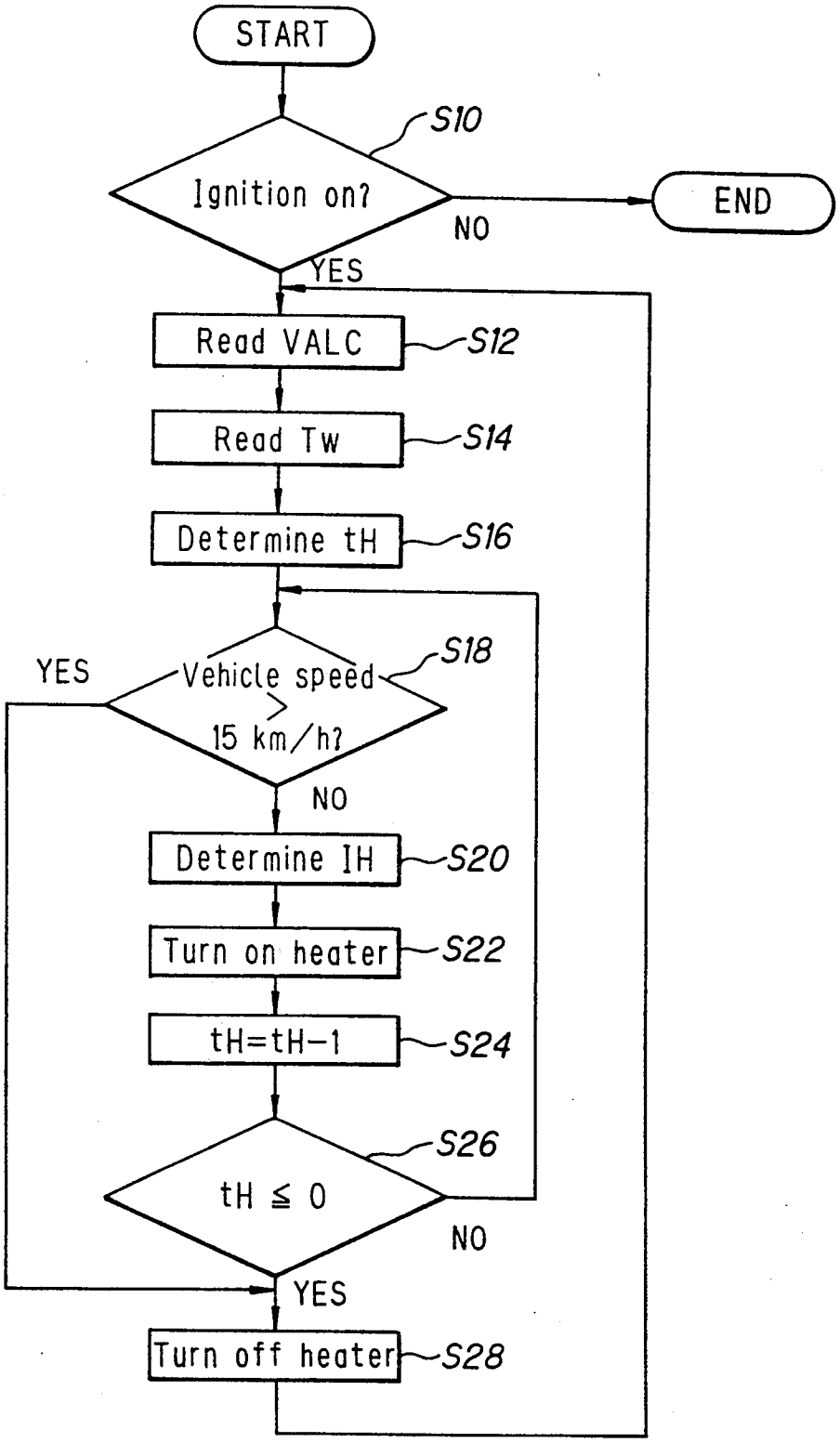
FIG. 3 is a flow chart showing the operation of the system shown in FIG. 1.

The operation of the system will now be explained with reference to the flow chart shown in FIG. 3.

After it is confirmed in step S10 that the ignition switch has been turned on, control passes to steps S12, S14 in which the alcohol concentration VALC and the engine coolant temperature Tw are read. Control then advances to step S16 in which the read-in values are used as address data for retrieving a heater on-time tH from a map, whereby the heater on-time tH is determined. Next, having confirmed at step S18 that the vehicle speed is below 15 km/h, control moves to step S20 in which the alcohol concentration VALC and engine coolant temperature Tw are again used as address data for retrieving the amount of current (current level) IH to be supplied to the heater 32 from a second map, whereby the heater current level IH is determined.

Figure 4:
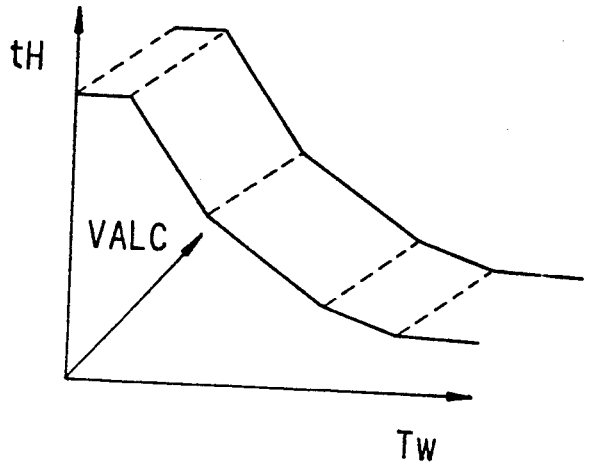
FIG. 4 is an explanatory view showing the characteristics of an on-time of the heater mounted in the spark plug referred in the flow chart of FIG. 3.
Figure 5:
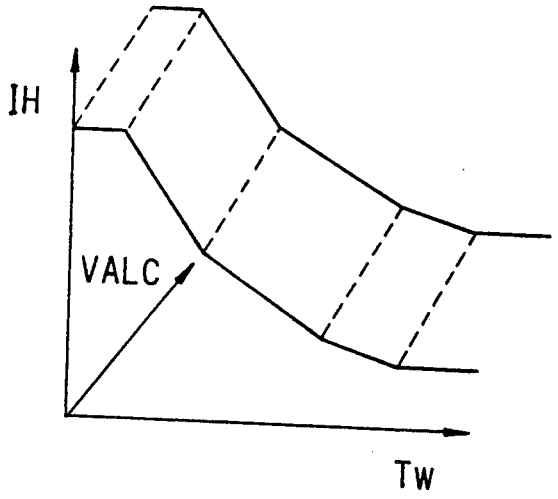
FIG. 5 is an explanatory view showing the characteristics of current level to be supplied to the heater mounted on the spark plug referred in the flow chart of FIG. 3.

FIGS. 4 and 5 illustrate the characteristics of the maps referred above. As illustrated, the heater on-time tH is predetermined such that it decreases with increasing engine temperature, i.e. engine coolant temperature Tw and also decreases with increasing alcohol concentration VALC. And the amount of current IH to be supplied to the heater increases with increasing alcohol concentration VALC and decreases with increasing engine coolant temperature Tw. It should be noted in the text that the "map" means look-up table(s) to be retrieved by two parameters, while a "table" a look-up table to be retrieved by a single parameter.

Returning to FIG. 3, control passes to step S22 in which supply of current to the heater 32 at the determined current level IH is then started. Then control advances to step S24 in which the heater on-time tH is decremented, to step S26 in which it is checked if the heater on-time tH reaches zero or less. And if not, control passes back to step S18 and thereafter, and thus the procedure is repeated until it has been confirmed that the heater on-time tH has reached zero or less if the vehicle may start, but its speed is still below the limit.

If the heater-on time tH is found, at step S26, to be zero or less, control passes to step S28 in which supply of current to the heater 32 is discontinued. After supply of current to the heater 32 has been discontinued, the outputs of the alcohol sensor 26 and the coolant temperature sensor 46, namely the alcohol concentration VALC and the engine coolant temperature Tw, are again read and the same procedure is repeated. Thus, the ECU 36 continues to output control signals for controlling the supply of current to the heater 32 for as long as the ignition switch is on. When the ignition switch is turned off, control by the ECU 36 is discontinued. Thus, supply of current to the heater 32 at the current level IH is continued until the originally decided heater on-time tH has lapsed.

However, when engine started and vehicle speed rises above 15 km/h, supply of current to the heater is discontinued immediately irrespective of the value of the heater on-time tH, since the engine starting is succeeded and vehicle traveling over such a speed could put a load on the engine and the spark plug 30 can therefore be protected from overheating.

Thus, once the ignition switch has been turned on and the engine started, blended alcohol-gasoline fuel is supplied from the fuel tank 22 to the fuel injector 20 which injects it toward the combustion chamber 12 of the main engine unit 10. The injected fuel mixes with the air being introduced through the intake manifold to form an air-fuel mixture that is introduced into the combustion chamber 12 of the main engine unit 10. Once in the combustion chamber 12, the air-fuel mixture is compressed by a piston. At the end of combustion stroke, a high voltage is applied across the electrodes 30*a*, 30*b* of the spark plug 30. The resulting spark discharge ignites the air-fuel mixture in the combustion chamber 12, causing it to burn explosively and drive down the piston. At the time the engine is started, the temperature in the vicinity of the spark plug 30 in the combustion chamber 12 is low. If the alcohol concentration of the blended fuel supplied to the combustion chamber 12 is high at this time, droplets of alcohol are apt to adhere to the electrodes 30*a*, 30*b* of the spark plug 30. This reduces the voltage across the electrodes 30*a*, 30*b*, making it hard to produce a spark.

The present system eliminates this problem. The alcohol concentration of the blended fuel being supplied to the combustion chamber 12 is detected by the alcohol sensor 26 and the engine temperature is detected by the coolant temperature sensor 46. If it is found that the alcohol concentration is high and the engine temperature low, i.e. if the condition is one in which liquid alcohol is apt to adhere to the electrodes 30*a*, 30*b* of the spark plug 30, the ECU 36 supplies a large current to the heater 32 mounted on the spark plug 30. The heater 32 therefore produces a large amount of heat, which raises the temperature of the spark plug electrodes 30*a*, 30*b* to a high level. As a result, any liquid alcohol adhering to the electrodes 30*a*, 30*b* is immediately vaporized. The high electrical insulation between the electrodes 30*a*,30*b* can therefore be maintained.

As will be understood from the foregoing, the system according to this embodiment is able to prevent liquid alcohol from adhering between the electrodes 30*a*, 30*b* of the spark plug 30. As this makes it possible to use a blended fuel with a high alcohol concentration even during the winter, it enables a reduction in gasoline consumption.

And since the time period for which heating of the spark plug 30 has to be continued for vaporizing liquid alcohol adhering between the electrodes is short, the period of time over which current has to be supplied to the heater 32 is also short. Since this means that a large current need be supplied only for a short period, the amount of electric power consumed by the heater 32 can be kept to a low level.

As the engine warms up and the temperature of the engine temperature increases, fuel vaporization proceeds more readily in the combustion chamber 12 and, therefore, less liquid alcohol adheres to the spark plug 30. The ECU 36 responds to the increasing engine temperature by selecting the optimum current level for the engine supplied to the heater 32. It also shortens the heater on-time. The amount of power consumed by the heater 32 is therefore minimized.

On the other hand, when the alcohol concentration of the blended fuel is low, i.e. when the gasoline concentration is high, little liquid fuel adheres to the electrodes 30*a*, 30*b* of the spark plug 30 even when the engine coolant temperature is low. Under such circumstances, the problem becomes instead that of carbon fouling. The system therefore reduces the amount of current supplied to the heater 32 mounted on the spark plug 30 to that required for heating the spark plug 30 to a temperature enabling burnoff of adhering carbon. This temperature is in the range of about 500°-600° C. It must be remembered, however, that carbon burnoff takes a relatively long time. The on-time over which the current is supplied to the heater 32 is therefore made longer than that in the case of a high alcohol concentration. However, since, as was just explained, the amount of current supplied to the heater 32 is reduced under these circumstances, the lengthening of the on-time does not result in increased power consumption.

While it was explained that the on-time of the heater 32 is varied in proportion to the alcohol content of the blended fuel, this is not absolutely necessary and, in some cases, it is possible to set a fixed heater on-time.

Figure 6:
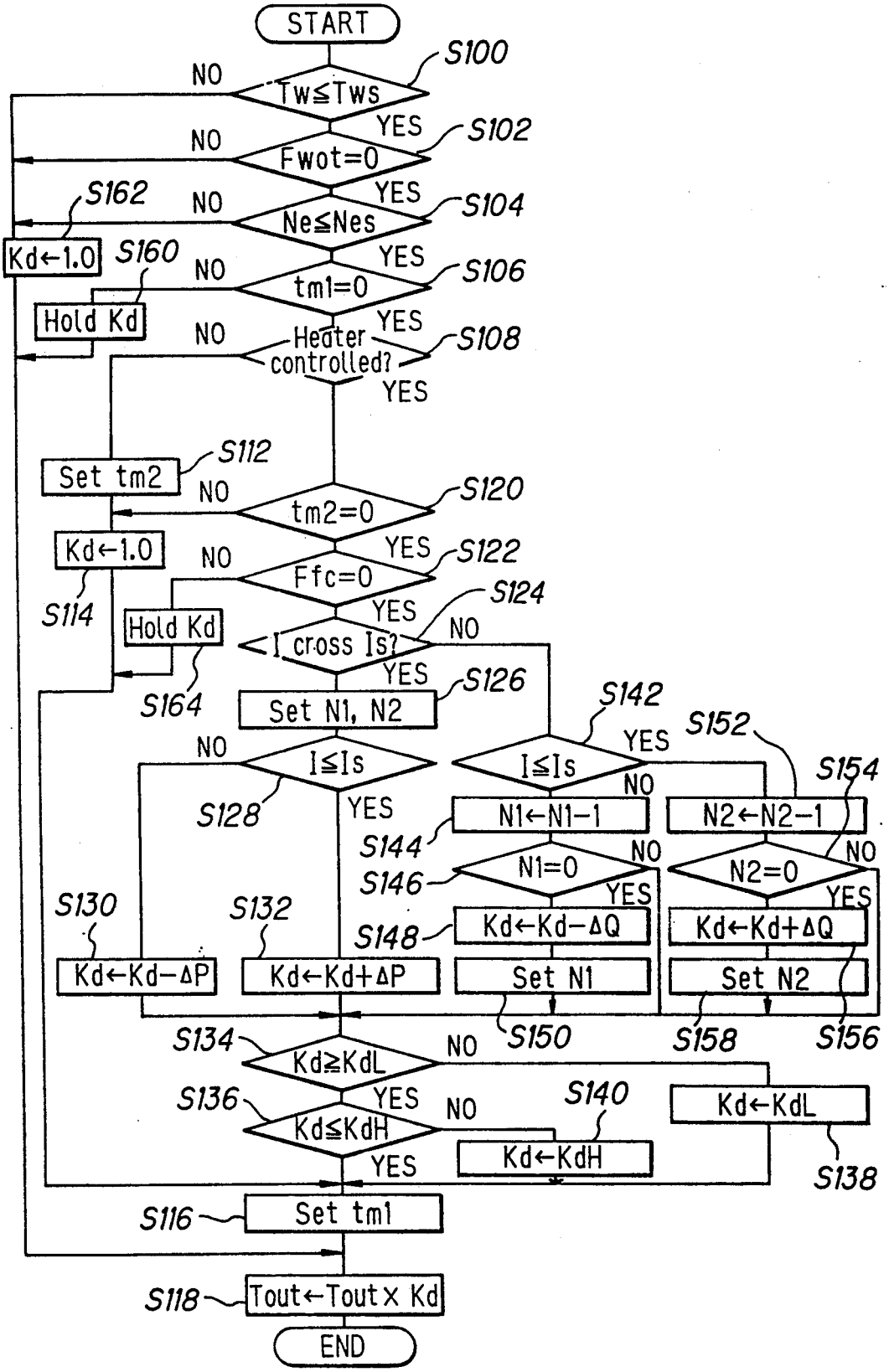
FIG. 6 is a flow chart showing the operation of the system according to a second embodiment of the invention.

FIG. 6 is a flow chart showing a second embodiment according to the invention.

In the gasoline-alcohol blend fuel, since latent heat of vaporization or atomization of alcohol is greater than that of gasoline, fuel vaporization decreases with increasing fuel alcohol concentration. For that reason, heater current is enlarged in the first embodiment in response to the alcohol concentration in the fuel. However, if greater amount of fuel, not atomized, adheres to the spark plug, the situation progressively degenerates because fuel is successively supplied while fuel, not yet atomized by heating, is still present on the spark plug. The spark plug could thus become wet, making the engine hard to start. The second embodiment aims to further improve low-temperature engine startability.

In the second embodiment, a fuel injection amount Tout is determined by multiplying by a correction coefficient Kd to reduce the amount so as to decrease fuel to be deposited on the spark plug.

FIG. 6 is the flow chart of a subroutine for calculating the correction coefficient Kd.

Figure 7:
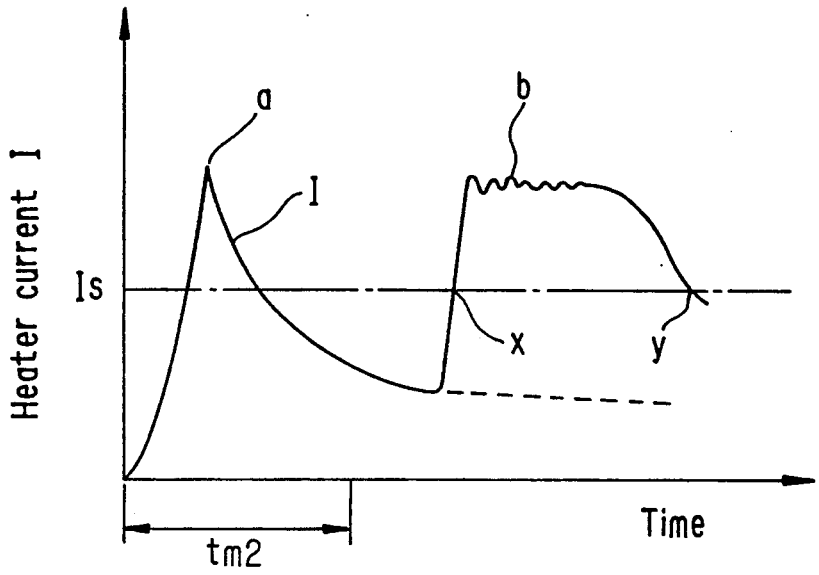
FIG. 7 is a graph showing current supplied to the heater with respect to time.
Figure 8:
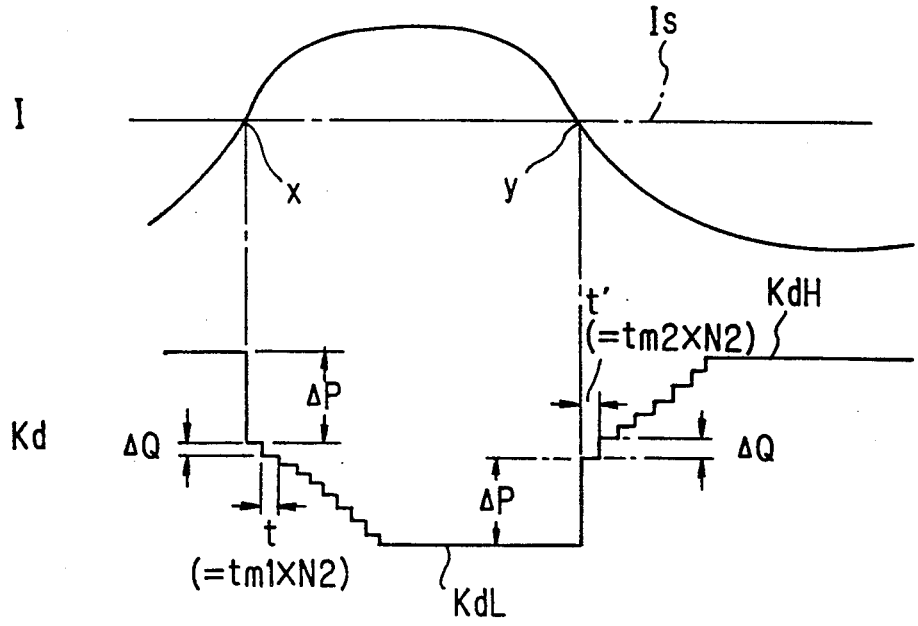
FIG. 8 is a timing chart for determining a correction coefficient to be used for reducing an amount of fuel injection.

Before entering the explanation, the procedure in the flow chart will be briefed referring to FIGS. 7 and 8.

The resistance of the heater 32 is normally relatively low at the beginning and increases as the temperature of the heater 32 rises owing to the passage of current therethrough. When the spark plug 30 becomes wet with fuel, its resistance decreases because its temperature falls owing to heat lost to the adhering fuel. FIG. 7 shows the change in current through the heater 32 under application of a fixed voltage. When current first starts to flow, it rises to a high level peaked at "a" because the resistance is low. Then as the resistance increases, the current decreases as illustrated by a dashed line.

However, if the alcohol concentration in the fuel is great and wetting of the spark plug 30 causes the resistance to decreases, the current rises again at "b". Therefore, as was explained earlier, the ammeter 38 is provided for enabling the resistance of the heater 32 to be indirectly detected from the amount of current passing through it, and the coefficient Kd is calculated on the basis of the results of a comparison between the detected current value I and a reference current value Is predetermined as a reference for discriminating whether or not the spark plug 30 is wet.

More specifically, when wetting of the spark plug causes the current value I to become larger than the reference value Is and crosses at "x", the coefficient Kd is first reduced by delta P and is further reduced progressively by a lesser amount delta Q at each time interval determined by multiplying a time period tm1 by a value N1 until it reaches the lower limit value of KdL, if the current I is still above the reference value Is. When the decrease in the amount of fuel injected resulting from the reduction of Kd leads to the spark plug no longer being wet so that the current value I becomes equal to or smaller than the reference value Is at "y", the coefficient Kd is first increased by delta P and is then progressively increased by increments of delta Q at each time interval (tm2×N2) until it reaches the upper limit value of KdH. Another time period tm1 is prepared for masking the initial high level peaked at "a" which is not caused by the plug's wetting.

Now, returning to FIG. 6, in step S100 of the flow chart, the coolant temperature Tw is compared with a prescribed value Tws (−20° C., for example). If coolant temperature Tw is at or below the prescribed value Tws, control passes to step S102 in which it is checked if a high-load increased fuel injection flag Fwot (which is set to one when the amount of fuel injected is increased under high load) is set to zero and, if the result is affirmative, to step S104 in which the engine speed Ne is compared with a prescribed value Nes (400 rpm, for example).

If the conditions TW≦Tws, Fwot=0 and Ne≦Nes are all satisfied, control passes to step S106 in which a first countdown timer is checked as to whether or not the time value tm1 is zero. The time period is initially zero so that control passes to step S108 in which it is checked if the heater 32 is supplied with current in accordance with a control which will be explained later with reference to the subroutine flow chart of FIG. 9. And, if it is not, to step S110 in which the heater 32 is turned on, to step S112 in which the time value tm2 (10 sec., for example) is set to a second countdown timer to start countdown, to step S114 in which the coefficient Kd is set to 1, and then to step S116 in which the time value tm1 (0.8 msec., for example) is set to the first countdown timer to start countdown, to step S118 in which the injection amount Tout is determined as illustrated (no reduction is made at this stage) and the program is once terminated.

In a following cycle, if the answer at step S108 is affirmative, control passes from S108 to S120 in which it is checked if the time value tm2 has reached zero and if it does not, to step S114 and thereafter. When the time value tm2 has found to be lapsed, control passes to step S122 in which it is checked if a fuel cut flag Ffc (which is set to one when the supply of fuel is cutoff as when, for example, the engine braking is being used) is set to zero and if it is, to step S124 and thereafter which are the steps in a process for changing the coefficient Kd on the basis of the resistance value of the heater 32.

In this step S124, it is checked if the detected current value I crosses the reference value Is and if it does, control passes to step S126 in which the count values N1, N2 (both 4, for example) are set to first and second counters, to step S128 in which it is checked if the current value I is at or below the reference value Is. If the current value I is found to be larger than the reference value Is, control passes to step S130 in which the coefficient Kd is updated to the value obtained by subtracting the prescribed value delta P from the value of Kd in the preceding cycle. On the other hand, if the current value I is found to be less than the reference value Is, control passes to step S132 in which the coefficient Kd is updated to the value obtained by adding the prescribed value delta P to the value of Kd in the preceding cycle. Then, control passes to step S134 in which the coefficient Kd computed in the aforesaid manner is compared with a prescribed lower limit value KdL (0.6, for example) and, if it is found that Kd is at or above KdL, to step S136 in which the coefficient Kd is again compared with a prescribed upper limit value KdH (1.0, for example) and, if Kd is at or below KdH, control passes, via step S116, to step S118 in which the value of Tout×Kd is calculated to correct the injection amount Tout. If the coefficient is found to be smaller than the lower limit KdL or larger than the upper limit KdH, control passes to step S138 or S140 in which the coefficient Kd is updated to the limit value KdL or KdH.

If it is found in step S124 that the detected current values I does not cross the reference value Is, control passes step S142 in which it is checked if the detected current value I is at or below the reference value Is. If the current value I is found to be larger than the reference value Is, control passes to step S144 in which the count value N1 of the first counter is decremented by one, to step S146 in which it is checked if the value N1 has become zero and, if it does, to step S148 in which the coefficient Kd is updated to the value obtained by subtracting the prescribed value delta Q (delta Q<<-delta P) from the value of Kd in the preceding cycle, and then to step S150 in which the value N1 is again set to the counter, and to step S134 and thereafter. If the value N1 is found to be not zero at step S146, control skips S148, S150.

If it is found in step S142 that the current value I is at or less than the reference value Is, control passes to step S152 in which the count value N2 of the second counter is decremented by one, to step S154 in which it is checked if the value N2 has reached zero and, if so, to step S156 in which the coefficient Kd is updated to the value obtained by adding the prescribed value of delta Q to the value of Kd in the preceding cycle, and then to step S158 in which the value N2 is again set to the counter, and to step S134 and thereafter. If the value N2 is found to be not zero at step S154, control jumps to step S134.

In the above, when control advances to step S106 and the time value tm1 is found to be not zero, control then passes to step S160 in which the coefficient Kd is held so the change of the coefficient by delta Q only occurs at a time interval of tm2×N1 (N2).

Incidentally, when it is found at step S100 or S104 that when Tw is greater than Tws or Ne is greater than Nes, there is no danger of the spark plug 30 being wetted. And if it is found in step S102 that the flag Fwot being set to one indicates that an increased amount of fuel is being supplied for raising the power output and that combustion is stable, namely a situation in which the amount of fuel supply should not be reduced. In these cases, therefore, control passes to step S162 in which the coefficient Kd is set to 1 so that no reduction of fuel supply is carried out. This is the same when the fuel cut flag is found to be set to one at step S122 so that control moves to step S164.

Figure 9:
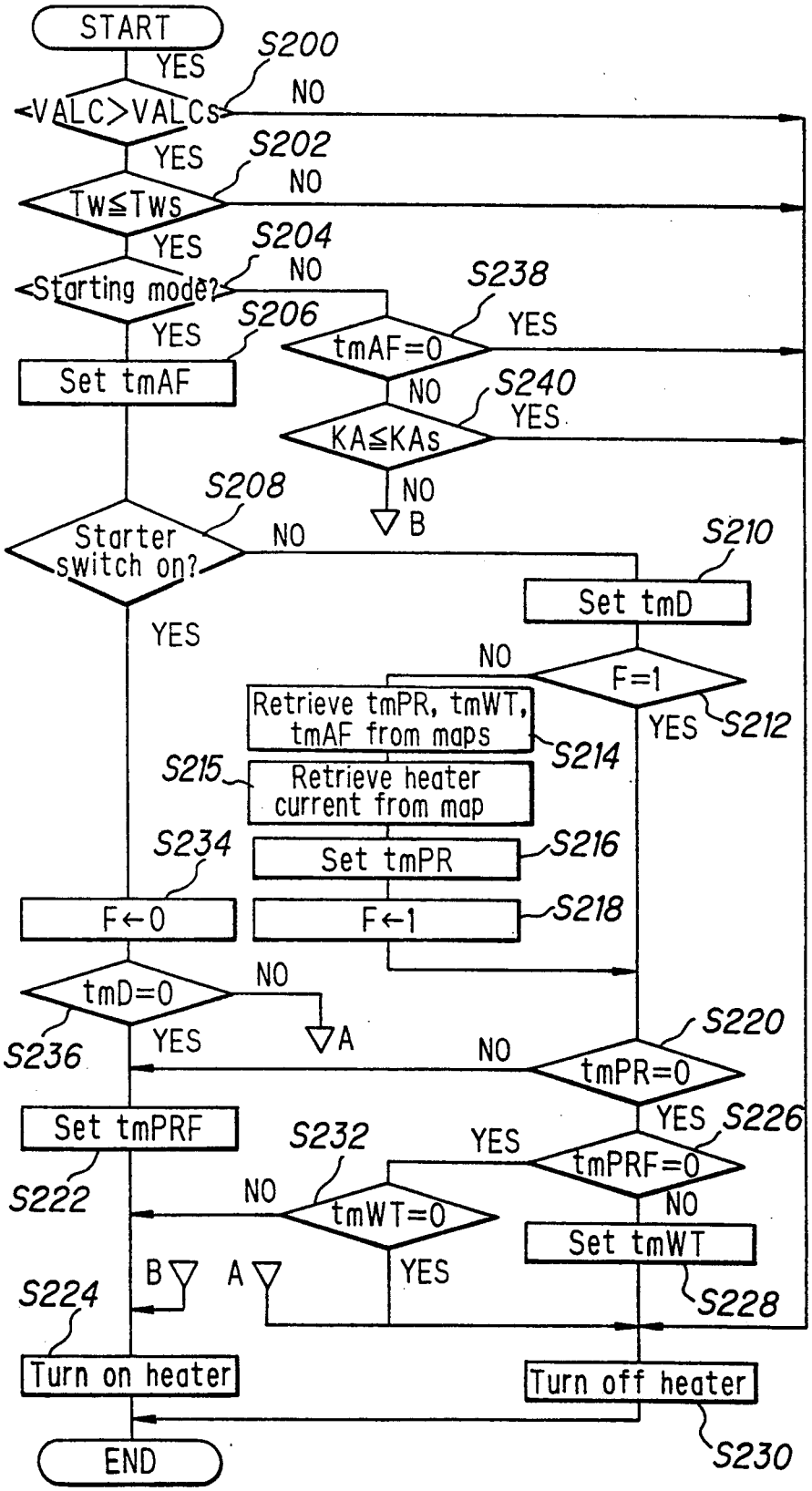
FIG. 9 is a subroutine flow chart showing the operation of a heater control referred in the flow chart of FIG. 6.

FIG. 9 is the subroutine flow chart showing the control of supplying the current to the heater 32 mentioned earlier.

As repeatedly mentioned, the engine starting performance tends to worsen with increasing alcohol concentration because a fuel with a high alcohol concentration is poorer in atomization property and, as such, tends to wet the spark plug at time of a cold engine start.

The aforesaid reference, Japanese Patent Publication No. 48(1983)-8651 teaches that the starting performance of an engine can be improved by mounting heater on the engine's spark plugs and turning on the heater to warm the spark plug tip when the ignition switch is turned on. In the proposed arrangement, the heater is turned on when the ignition switch is turned and remain on even after the starter switch is turned on. When the starter switch is turned on, a large amount of power is suddenly required to operate the starter motor Because of this, if, as in arrangement described in the aforesaid prior art, the heater is left on even after the starter switch is turned on, there may be insufficient power available to operate the starter motor.

The control illustrated in FIG. 9 enables the starter motor to be supplied with sufficient electric power for its operation when the starter switch is turned on, for the engine, in particular, using the gasoline-alcohol blend fuel.

The procedure begins when the ignition switch is turned on and at the first step S200, the alcohol concentration VALC is compared with a prescribed value VALCs (60%, for example). If the alcohol concentration VALC is found to be greater than the value VALCs, control passes to step S202 in which the coolant temperature Tw is compared with a prescribed value Tws (−20 ° C., for example). If the coolant temperature Tw is found to be at or below the value Tws, control passes to step S204 in which it is checked if the engine is in the starting (cranking) mode. Before an engine has started i.e. before the crankshaft rotates without the aid of the starter motor, the result of this checking is that the engine is in the mode and control passes to step S206 in which an after-heating countdown timer is set to a time period tmAF retrieved from a map to be explained later to start countdown, and then to step S208 in which it is checked if the starter switch is on. In the first cycle, the starter switch will not be on and control passes to step S210 in which another countdown timer for determining the period during which the heater is to be turned off following turn-on of the starter switch is set to a prescribed value tmD to start countdown and then passes to step S212 in which it is checked if a timer check flag F is set to 1. As this flag is initially set to zero, control passes to step S214 in which a time value tmPR of a preheating countdown timer, a time tmWT of a standby heating countdown timer and the time tmAF of the aforesaid after-heating countdown timer are retrieved from maps. These times indicate periods during which current is continuously supplied to the heater 32.

Figure 10:
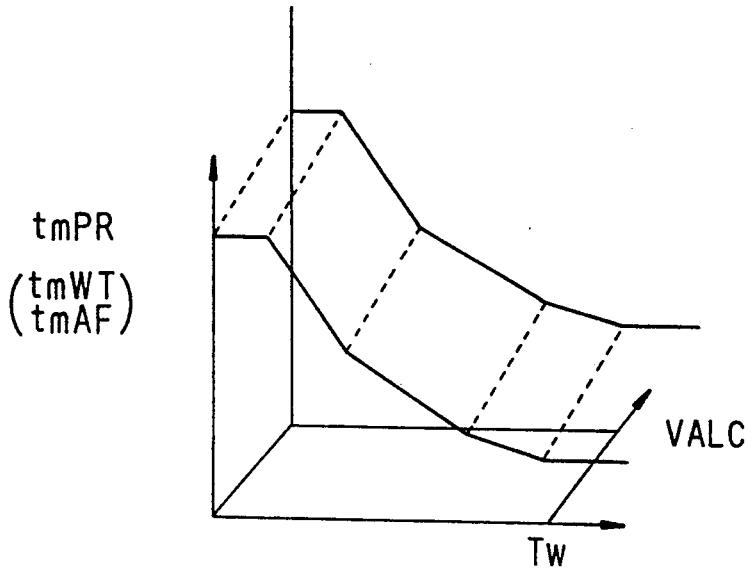
FIG. 10 is an explanatory view showing the characteristics of various time values referred in the subroutine flow chart of FIG. 10.

As shown in FIG. 10 illustrating the characteristics of the maps, the time values tmPR, tmWT and tmAF are all predetermined as a function of the engine temperature, i.e. engine coolant temperature Tw and the alcohol concentration VALC, such that the times become longer as the coolant temperature Tw decreases and the alcohol concentration VALC increases.

Then, control passes to step S215 in which an amount or a level of the current to be supplied to the heater 32 is similarly retrieved from a map, which is the same as that of the first embodiment illustrated in FIG. 5, using the same parameters as address data.

After the retrieval, control passes to step S216 in which time value tmPR is set to the third counter to start countdown, to step S218 in which the flag F is set to 1 and to step S220 in which it is checked if the time tmPR has lapsed. While the time tmPR becomes zero, control passes to step S222 in which a time value tmPRF of a fifth countdown timer for determining the preheating interrupt time is set to start countdown and to step S224 in which the heater 32 is turned on.

In a following cycle, when the time tmPR is found to have become zero in step S220, control passes to step S226 in which it is checked if the time tmPRF, which is repeatedly restarted each time control passes step S222, has become zero. Following the time at which tmPR becomes zero but during the lapse of the time to which the time tmPRF becomes zero, control passes to step S228 in which the time value tmWT is set to the countdown counter to start countdown and to step S230 in which the heater 32 is turned off.

When it is found in step S226 that the time tmPRF has become zero, control passes to step S232 in which it is checked if the time tmWT has become zero. Following the time at which tmPRF becomes zero but during the time tmWT becomes zero, control passes to step S224 to keep the heater 32 on. After the time value tmWT has become zero, control passes to step S230 to turn the heater 32 off.

Figure 11:
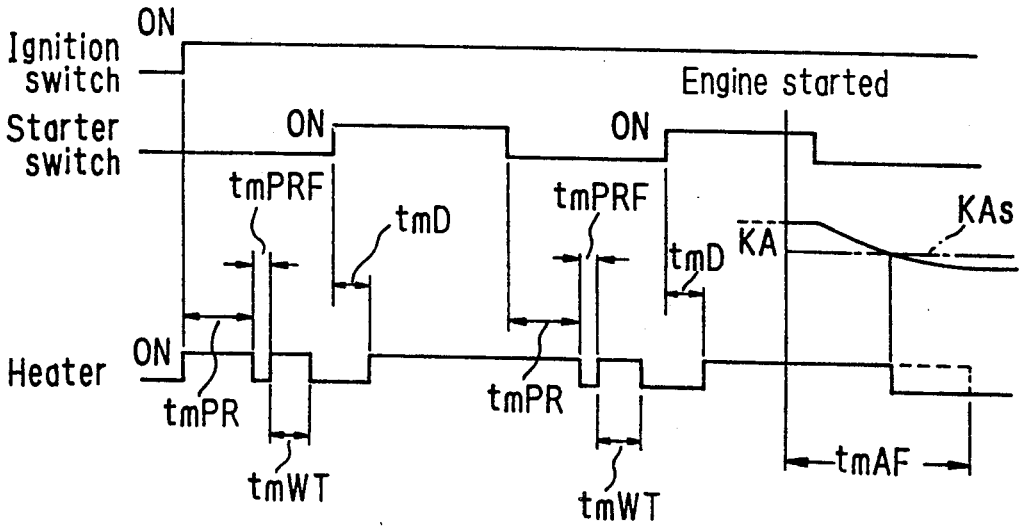
FIG. 11 is a timing chart showing the operation of the heater control according to the subroutine flow chart of FIG. 9.

Thus, as shown in FIG. 11, after the ignition switch is turned on, the heater 32 is turned on for the time tmPR. As a result, the temperature of the heater 32 rises high enough to vaporize the fuel. Although the operator turns on the starter switch shortly after the heater 32 is turned on, so long as the starter switch is still in the off position, once the time to which tmPRF was set has lapsed, the heater 32 is again turned on for the time to which the tmWT is set.

When the starter switch has been turned on, control passes from step S208 to step S234, whereby the flag F is set to zero, and, following this, to step S236 in which it is checked if the time value tmD is zero. As explained earlier, the time period of TmD is repeatedly restarted each time control passes step S210 i.e, just before the starter switch is turned on so that the time tmD is not zero between the point in time at which the starter is turned on and the point in time at which the set period of time lapses. Control then passes to step S230 in which the heater is turned off and then, when the it is found in step S236 that time value tmD has become zero, passes to step S224, via step S222, for turning on the heater 32. As a result, after the starter switch is turned on, no current is supplied to the heater 32 during the lapse of the set period of tmD. It is therefore possible to supply the starter motor with sufficient power.

When the engine has not started while the starter switch is on, the supply of current to the heater 32 is controlled in the same manner as described above after the starter switch is turned off, and when the starter switch is again turned on, the heater 32 is turned on after the lapse of the time period to which the value tmD was set. When the engine has started, control passes from step S204 to step S238 in which it is checked if the time tmAF has lapsed. As explained earlier, the time period of tmAF is set in step S206 just before engine starting After the engine has started and up to the lapse of the set period, control passes to step S240 in which a start time fuel increase coefficient KA used for calculating the amount fuel to be injected Tout($=$Tout$\times$KA) is compared with a reference value KAs. Since when the coefficient KA is larger than the reference value KAs the amount of fuel injected is large and the probability of spark plug wetting is high, control passes to step S224 for temporarily turning on the heater 32 even after firing so as to stabilize the combustion. On the other hand, if the time tmAF has lapsed or the coefficient KA is at or below the reference value KAs, control passes to step S230 for turning off the heater 32.

Since as explained in the foregoing the time values tmPR, tmWT and tmAF are made longer with decreasing engine temperature, i.e. engine coolant temperature Tw and increasing alcohol concentration, the on-time of the heater 32 is increased under conditions conducive to wetting of the spark plug 30. Because of this, there is no danger of the engine starting performance being degraded owing to insufficient spark plug heating.

In the second embodiment, although current is used to presume the resistance for determining the coefficient Kd, it may alternatively possible to use voltage instead. Further it may be possible to use current or voltage itself for determining the amount of the coefficient Kd.

It should be noted further that if, as is sometimes the case, the voltage applied to the heater 32 is varied in proportion to the alcohol concentration, Is is varied in line with the variation in voltage.

Moreover, while in the foregoing embodiment, the coefficient Kd is decreased for reducing the amount of fuel supplied when the current value I is above the reference value Is, it is alternatively possible to use an arrangement in which the coefficient Kd is made zero for cutting off the supply of fuel at such times.

While in the aforesaid embodiments, the engine uses a gosoline-alcohol blend fuel, it can also be applied to an engine using a neat gasoline fuel to improve its startability.

Moreover, the aforesaid embodiments are explained with respect to a system in which the blended fuel is injected by the fuel injector 20, the invention is not limited to this arrangement and can also be applied with similar effect to an engine with a carburetor.

Furthermore, the aforesaid embodiments are explained separately, it may alternatively possible to combine them in an appropriate manner.

While the aforesaid embodiments are explained with respect to a system in which an engine temperature is detected through an engine coolant temperature, it may alternatively possible to detect it by sensing a temperature of oil in the engine or air drawn into the engine.

The present invention has thus been shown and described with reference to the specific embodiments. However, it should be noted that the present invention is in no way limited to the details of the described arrangements, but changes and modifications may be made without departing from the scope of the appended claims.

What is claimed is:

1. A system for controlling a heater mounted on a spark plug which ignites the air-fuel mixture in a combustion chamber of an internal combustion engine using a gasoline-alcohol blend fuel, comprising:

first means for detecting alcohol concentration in the fuel; and control means for controlling an amount of current to be supplied to the spark plug heater in such a manner that the amount of current to be supplied to the spark plug heater increases with increasing alcohol concentration in the fuel.

2. A system according to claim 1, further including second means for detecting an engine temperature, and said control means increases the amount of current to be supplied to the spark plug heater with decreasing engine temperature.

3. A system according to claim 1, wherein said control means controls a time during which the current is supplied to the spark plug heater in such a manner that the time decreases with increasing alcohol concentration.

4. A system according to claim 1, further including second means for detecting an engine temperature, and said control means controls a time during which the current is supplied to the spark plug heater in such a manner that the time decreases with increasing engine temperature.

5. A system according to claim 1, further including third means for detecting a traveling speed of a vehicle in which the engine is mounted on, and said control means discontinues supplying the current to the spark plug heater when the vehicle speed exceeds a predetermined speed.

6. A system according to claim 1, wherein said control means supplies the current to the spark plug heater when an ignition switch of the engine is turned on.

7. A system for controlling a heater mounted on a spark plug which ignites the air-fuel mixture in a combustion chamber of an internal combustion engine using a gasoline-alcohol blend fuel, comprising:

first means for detecting alcohol concentration in the fuel;

second means for detecting resistance in the spark plug heater;

heater control means for controlling an amount of current to be supplied to the spark plug heater in response to the detected alcohol concentration; and fuel control means for controlling an amount of fuel to be supplied to the engine in response to the detected resistance in the spark plug;

wherein:

said fuel control means decreases the fuel amount when the resistance in the spark plug heater becomes at or below a predetermined value.

8. A system according to claim 7, wherein said fuel control means decreases the fuel amount by a predetermined unit amount until it reaches a predetermined limit when the resistance in the spark plug heater becomes at or below the predetermined value.

9. A system according to claim 8, wherein said fuel control means decreases the fuel amount by the predetermined unit amount when the resistance in the spark plug heater becomes at or below the predetermined value after a predetermined time has lapsed since the heater was turned on.

10. A system according to claim 7, wherein said fuel control means increases the fuel amount by a second predetermined unit amount until it reaches a second predetermined limit when the resistance in the spark plug heater becomes at or above the predetermined value.

11. A system according to claim 7, wherein said second means detects the resistance in the spark plug heater through the amount of current supplied to the spark plug heater.

12. A system according to claim 7, further including third means for detecting an engine temperature, and said fuel control means decreases the fuel amount when the engine temperature is at or below a predetermined temperature.

13. A system for controlling a heater mounted on a spark plug which ignites the air-fuel mixture in a combustion chamber of an internal combustion engine using a gasoline-alcohol blend fuel, comprising:

first means for detecting alcohol concentration in the fuel;

second means for detecting if a starter motor is turned on; and control means for supplying current to the spark plug heater when an ignition switch is turned on;

wherein:

said control means discontinues supplying the current to the spark plug heater for a predetermined period if the starter motor is turned on when the detected alcohol concentration is at or above a predetermined concentration.

14. A system according to claim 13, wherein said control means supplies the current to the spark plug heater for a second predetermined period after the engine has started.

15. A system according to claim 13, wherein said control means increases the second predetermined period with increasing alcohol concentration in the fuel.

16. A system according to claim 14, further including third means for detecting an engine temperature, and said control means decreases the second predetermined period with increasing engine temperature.

17. A system according to claim 14, wherein said control means supplies the current to the spark plug heater for the second predetermined period if an additional fuel amount to be supplied to the engine after it has started is above a reference amount.

18. A system according to claim 13, wherein said control means supplies the current to the spark plug heater for a third predetermined period if the starter motor is not turned on when the ignition switch is turned on.

19. A system according to claim 18, wherein said control means increases the third predetermined period with increasing alcohol concentration in the fuel.

20. A system according to claim 18, further including third means for detecting an engine temperature, and said control means decreases the third predetermined period with increasing engine temperature.

21. A system according to claim 13, wherein said control means controls an amount of current to be supplied to the spark plug heater in such a manner that the amount of current to be supplied to the spark plug heater increases with increasing alcohol concentration in the fuel.

22. A system according to claim 13, further including third means for detecting an engine temperature, and said control means increases the amount of current to be supplied to the spark plug heater with decreasing engine temperature.

* * * * *